US007008273B2

(12) United States Patent
Zhou

(10) Patent No.: US 7,008,273 B2
(45) Date of Patent: Mar. 7, 2006

(54) CABLE CONNECTOR ASSEMBLY AND METHOD OF MAKING THE SAME

(75) Inventor: Hong Bin Zhou, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/903,165

(22) Filed: Jul. 30, 2004

(65) Prior Publication Data

US 2005/0026514 A1 Feb. 3, 2005

(30) Foreign Application Priority Data

Jul. 30, 2003 (TW) ..... 92120918 A

(51) Int. Cl.
*H01R 4/02* (2006.01)

(52) U.S. Cl. ..... 439/874

(58) Field of Classification Search ..... 439/874, 439/875, 675; 29/857, 860
See application file for complete search history.

(56) References Cited

U.S. PATENT DOCUMENTS 1,496,142 A * 6/1924 Wirkkala ..... 403/274
1,875,241 A * 8/1932 Idank ..... 439/888
1,900,585 A * 3/1933 Reed ..... 439/874
2,424,938 A * 7/1947 Lundy ..... 439/491
2,507,780 A * 5/1950 Gilbert ..... 228/139
3,437,774 A * 4/1969 Snider ..... 200/275
3,593,002 A * 7/1971 Hebert ..... 219/541
3,715,708 A * 2/1973 Lloyd et al. ..... 439/675
4,431,254 A * 2/1984 Cartesse ..... 439/610
4,966,565 A * 10/1990 Dohi ..... 439/874
5,023,403 A * 6/1991 Eckardt et al. ..... 174/94 R
5,222,811 A * 6/1993 Miyoshi ..... 374/208
5,725,400 A * 3/1998 Morikawa et al. ..... 439/874
6,537,113 B1 3/2003 Chen
6,672,913 B1 * 1/2004 Wang ..... 439/874

* cited by examiner

*Primary Examiner*—Ross Gushi
(74) *Attorney, Agent, or Firm*—Wei Te Chung

(57) ABSTRACT

A cable connector assembly (1) in accordance with the present invention includes a plug (3), a cable (4) and a fusible element (5). The plug comprises a terminal (30) having a connecting portion (301). The connecting portion defines a hole (304) extending through a first and an opposite second faces (302, 303) thereof. The fusible element is filled in the hole (304). The cable includes a wire (40) having a soldering portion (400). The soldering portion includes a first tail (401) and a second tail (402) respectively soldered onto the first and the second faces. The first and the second tails are connected with each other by the fusible element.

15 Claims, 3 Drawing Sheets

CABLE CONNECTOR ASSEMBLY AND METHOD OF MAKING THE SAME

BACKGROUND OF THE INVENTION

1. Field of the Invention

The present invention relates to a cable connector assembly and a method of making the same, and particularly to an improved method for connecting a cable to a plug of a cable connector assembly.

2. Description of Related Art

A power supply system of a notebook computer commonly includes a power jack disposed inside the notebook computer and a power cable connector assembly disposed outside the notebook computer. The power cable connector assembly includes a power plug adapted for engaging with the power jack and a cable having an end electrically connecting with the power plug and another end for connecting to a power supply device. The cable comprises a wire having a plurality of conductors exposed outside to connect with a contact of the power plug.

Generally, there are two types of connecting means between the contact and the wire. A first type is that the wire is directly soldered onto a surface of a tail of the contact. However, due to inherent characteristic of this soldering means, the connection between the plug and the wire is easy to become loose when the cable is subject to a large force. The second type is that the wire is soldered to the tail of the contact after the wire penetrates through a hole of the tail.

As the increase of peripheral equipments of the notebook computer, the power supplied to the notebook computer increases. The wire needs to be thickened to carry the increasing current. Under this circumstance, if the second type of the connecting means between the plug and the cable is adopted, the size of the contact of the plug must be correspondingly enlarged to define a larger hole to accommodate the thickened wire. The contact having the large size is adverse to the continuing trend toward miniaturization of the electronic industry.

Hence, an improved method for connecting a wire to a contact of a cable connector assembly is desired to overcome the disadvantage of the prior art.

SUMMARY OF THE INVENTION

An object of the present invention is to provide an improved method for reliably connecting a cable to a plug of a cable connector assembly.

Another object of the present invention is to provide a cable connector assembly having a plug and a cable with a reliable connection therebetween.

To achieve the above object, a cable connector assembly in accordance with the present invention comprises a plug, a cable and a fusible element. The plug comprises a terminal having a connecting portion. The connecting portion defines a hole extending through a first and an opposite second faces thereof. The fusible element is filled in the hole. The cable includes a wire having a soldering portion. The soldering portion includes a first tail and a second tail respectively soldered onto the first and the second faces. The first and the second tails are connected with each other by the fusible element. A method of making the cable connector assembly is also disclosed in the present invention.

Other objects, advantages and novel features of the invention will become more apparent from the following detailed description when taken in conjunction with the accompanying drawings.

DETAILED DESCRIPTION OF THE PREFERRED EMBODIMENT

Figure 1:
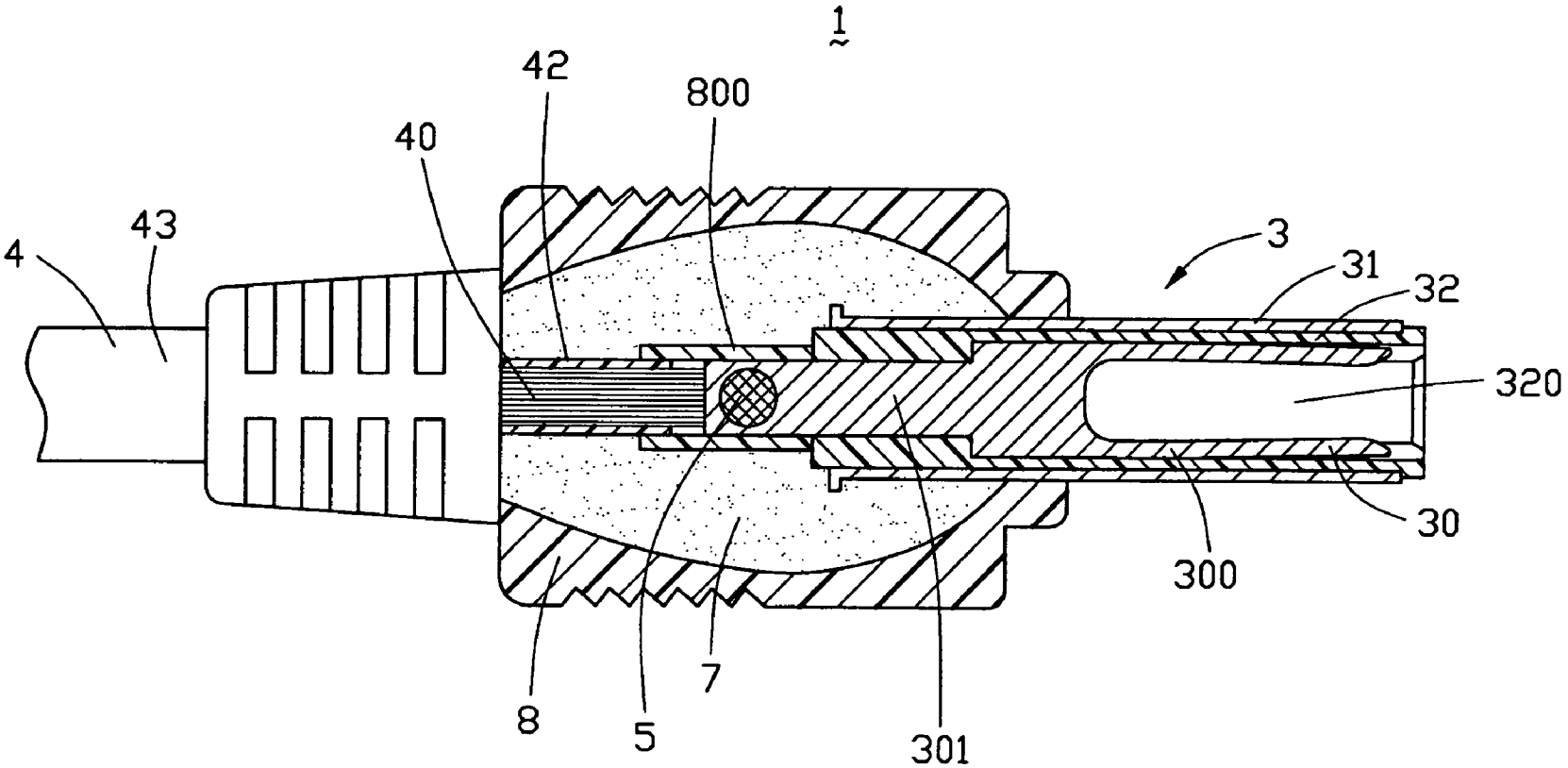
FIG. 1 is a cross-sectional view of a cable connector assembly in accordance with the present invention, showing an inner structure of a plug of the cable connector assembly.

Referring to FIG. 1, a cable connector assembly 1 in accordance with the present invention is commonly used to transmit power from a power supply to a notebook computer. The cable connector assembly 1 comprises a plug 3 and a cable 4 electrically and mechanically connecting with the plug 3.

Figure 3:
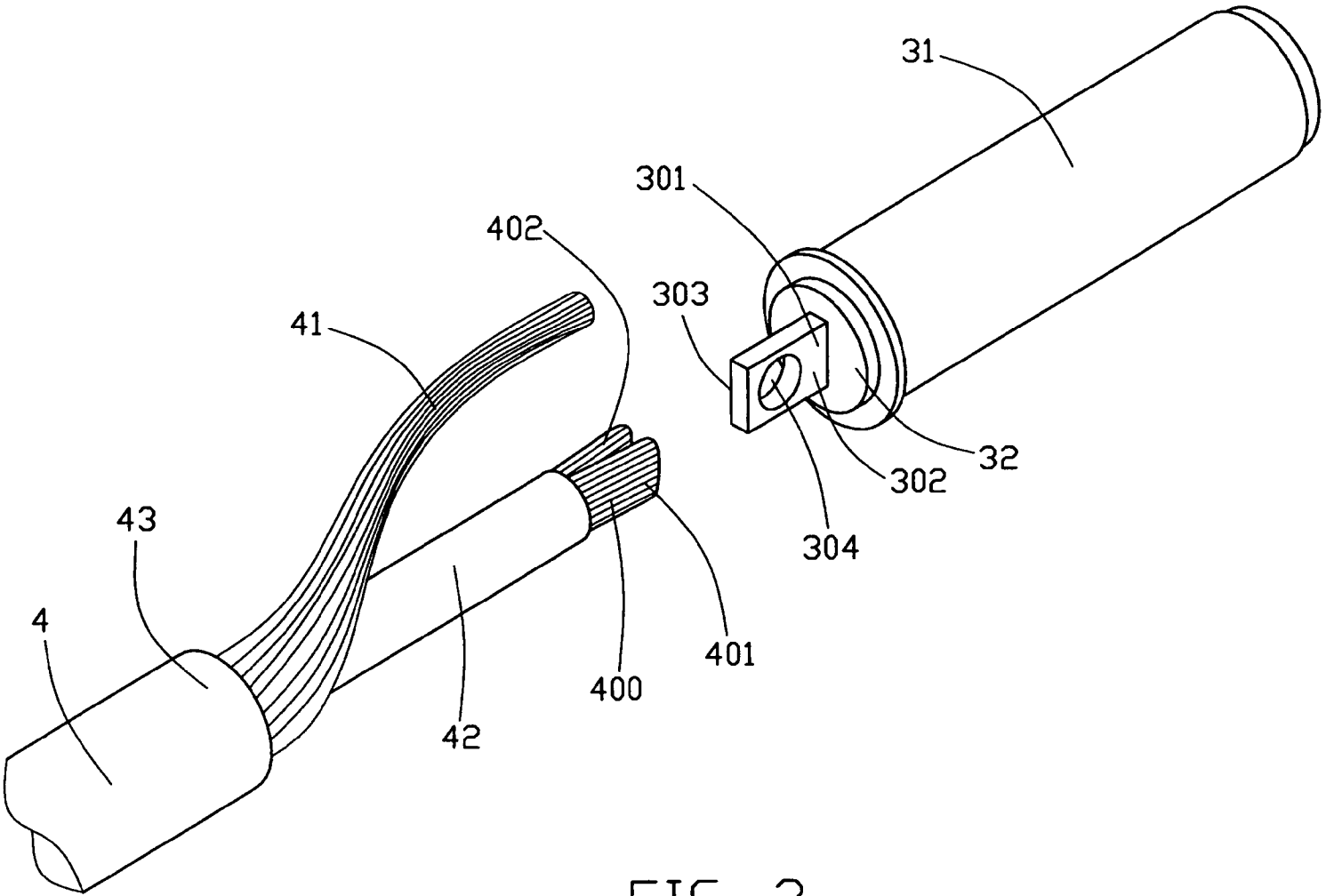
FIG. 3 is an exploded perspective view of the plug and the cable of the cable connector assembly shown in FIG. 1.

Referring to FIGS. 1 and 3, the plug 3 comprises a first terminal 30 and a second terminal 31. The second terminal 31 is shaped as a hollow cylinder. The first terminal 30 is stamped from an elongated plate and comprises a forked contact portion 300 surrounded by the second terminal 31 and a connecting portion 301 exposed out of the second terminal 31. The connecting portion 301 has a first face 302, an opposite second face 303 and a hole 304 extending through the first and the second faces 302, 303. The plug 3 also comprises a dielectric housing 32 disposed between the first and the second terminals 30, 31 for insulating the first and the second terminals 30, 31. The dielectric housing 32 and the contact portion 300 of the first terminal 30 together define a receiving space 320 for receiving a terminal of a complementary connector (not shown).

Figure 2:
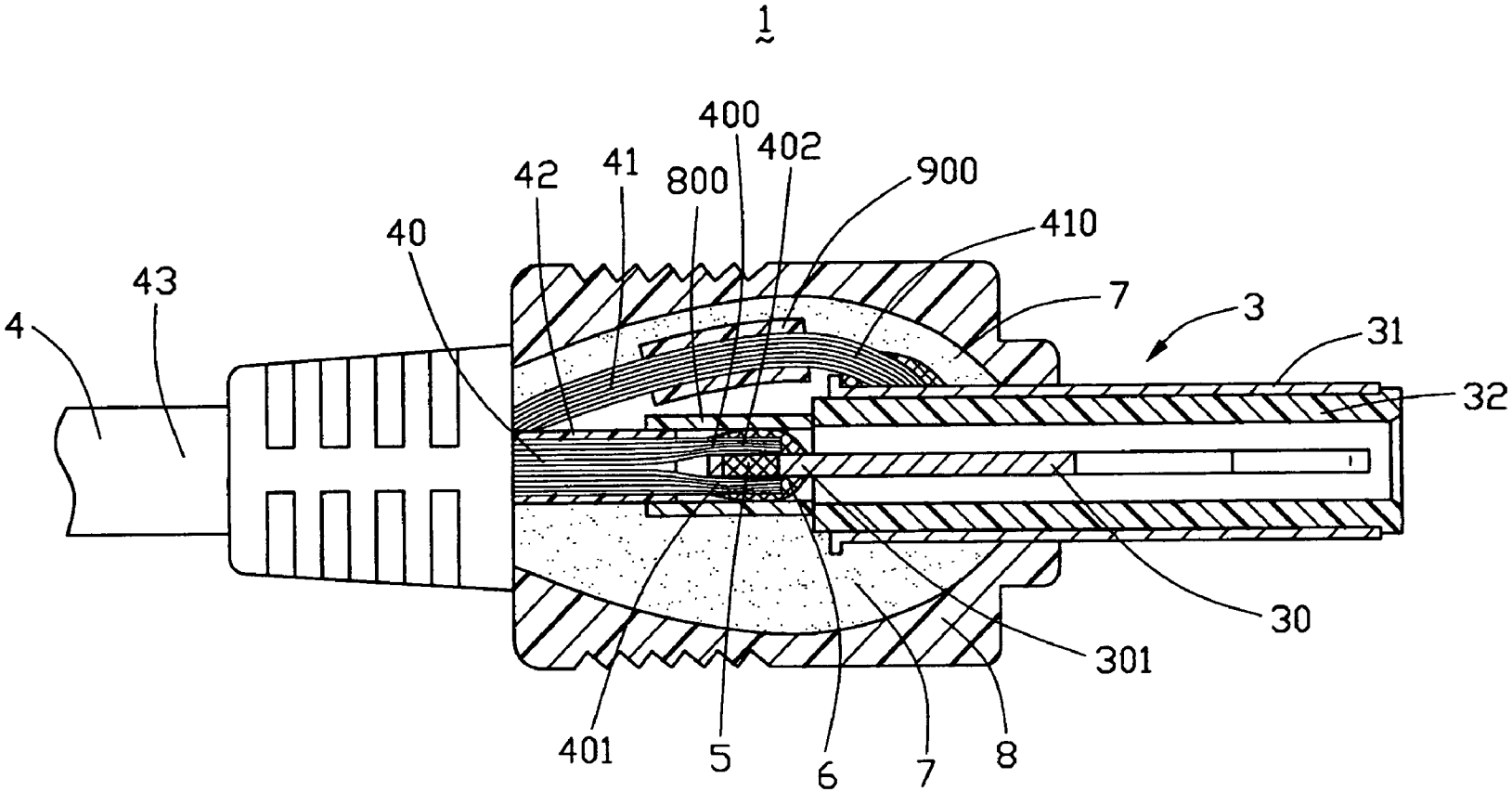
FIG. 2 is a cross-sectional view taken from another aspect of the cable connector assembly in accordance with the present invention, showing a connection of the plug and a cable of the cable connector assembly.

Referring to FIGS. 2 and 3, the cable 4 comprises an inner wire 40, an insulator 42 surrounding the inner wire 40, an outer wire 41 twisted around the insulator 42 and a jacket 43 enclosing the outer wire 41. Each of the inner and the outer wires 40, 41 consists of a plurality of conductors. The inner wire 40 comprises a first soldering portion 400 exposed out of the inner insulator 42. The first soldering portion 400 is separated into a first tail 401 and a second tail 402. The outer wire 41 comprises a second soldering portion 410 exposed out of the jacket 43.

Referring to FIG. 2 in conjunction with FIG. 3, in a process of soldering the cable 4 to the plug 3, firstly, the hole 304 of the connecting portion 301 of the first terminal 30 is filled with inner solder 5. Secondly, the first and the second tails 401, 402 of the first soldering portion 400 of the inner wire 40 are respectively soldered onto the first and the second faces 302, 303 of the connecting portion 301 by outer solder 6. The first and the second tail 401, 402 are integrated with each other by the inner and the outer solder 5, 6, thereby ensuring a reliable electrical connection between the inner wire 40 and the first terminal 30. Finally, the soldering portion 410 of the outer wire 41 is soldered onto an outer face of the second terminal 32.

Referring to FIG. 2, the cable connector assembly 4 further comprises a first insulating portion 800 enclosing the soldering portion 400 of the inner wire 40 and the connecting portion 301 of the first terminal 30, and a second insulating portion 900 enclosing the soldering portion 410 of the outer wire 41, thereby ensuring a first circuit, which is generated between the first terminal 30 and the inner wire

40, completely insulating from a second circuit, which is generated between the second terminal 31 and the outer wire 41.

Referring to FIG. 2, the cable connector assembly 1 further comprises an inner cover 7 over-molded around the plug 3 and the cable 4 and an outer cover 8 over-molded around the inner cover.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a plug comprising a terminal having a connecting portion, the connecting portion defining a hole extending through a first and an opposite second faces thereof;

a fusible element filled in the hole; and a cable comprising a wire having a soldering portion, the soldering portion including a first tail and a second tail respectively soldered onto the first and the second faces, the first and the second tails being connected with each other after the fusible element is melted.

2. The cable connector assembly as claimed in claim 1, wherein the plug comprises another terminal and a dielectric housing disposed between the another terminal and the terminal.

3. The cable connector assembly as claimed in claim 2, wherein the terminal comprises a forked contact portion surrounded by the another terminal, and wherein the connecting portion of the first terminal is exposed out of the another terminal.

4. The cable connector assembly as claimed in claim 2, wherein the cable comprises an insulator surrounding the wire, another wire twisted around the insulator and a jacket enclosing the another wire, and wherein the another wire comprises a soldering portion soldered to the another terminal.

5. The cable connector assembly as claimed in claim 4, further comprising a first insulated portion surrounding the soldering portion of the wire and the connecting portion of the terminal, and a second insulated portion surrounding the soldering portion of the another wire.

6. The cable connector assembly as claimed in claim 5, further comprising an inner cover over-molded around the plug and the cable and an outer cover over-molded around the inner cover.

7. The cable connector assembly as claimed in claim 4, wherein the wire and the another wire both comprise a plurality of conductors.

8. The cable connector assembly as claimed in claim 1, wherein the fusible element is solder.

9. A method for making a cable connector assembly, comprising the steps of:

providing a plug comprising a terminal having a connecting portion, the connecting portion defining a hole extending through a first and a opposite second faces thereof;

providing a cable comprising a wire having a soldering portion including a first tail and a second tail;

filling the hole with a fusible element therein; and soldering the first and the second tails onto the first and the second faces, respectively, the first and the second tails being connected with each other after the fusible element is melted.

10. The method as claimed in claim 9, wherein the plug comprises another terminal and a dielectric housing located between the terminal and the another terminal.

11. The method as claimed in claim 10, wherein the cable comprises an insulator surrounding the wire, another wire twisted around the insulator, and a jacket surrounding the another wire, and wherein the another wire comprises a soldering portion soldered to the another terminal.

12. The method as claimed in claim 9, wherein the fusible element is solder.

13. A cable connector assembly comprising:

a plug comprising a first terminal, a second terminal and a dielectric housing disposed between the first and the second terminals, the first terminal having a connecting portion, the connecting portion defining opposite first and second faces thereof;

a cable comprising a wire having a soldering portion, the soldering portion including a first tail and a second tail respectively located onto and mechanically and electrically connecting the first and the second faces.

14. The cable connector assembly as claimed in claim 13, further comprising a fusible element and wherein said connecting portion defines a through hole extending through both said first and second faces, and said fusible element is filled within said through hole to mechanically and electrically connecting said first and second tails together.

15. The cable connector assembly as claimed in claim 13, further comprising another wire mechanically and electrically connected to the second terminal.

* * * * *